United States Patent [19]

Mori

[11] Patent Number: 4,572,383

[45] Date of Patent: Feb. 25, 1986

[54] CRANE

[76] Inventor: Kei Mori, 3-16-3-501, Kaminoge, Setagaya-ku, Tokyo, Japan

[21] Appl. No.: 629,939

[22] Filed: Jul. 12, 1984

[30] Foreign Application Priority Data

Aug. 19, 1983 [JP] Japan ..... 58-151809

[51] Int. Cl.[4] ..... B66C 23/04; B66C 7/00; B66C 5/04; B66C 23/72

[52] U.S. Cl. ..... 212/264; 212/231; 212/257; 212/208; 212/142; 212/225; 212/237; 212/260; 212/195

[58] Field of Search ..... 212/211, 142, 223, 225, 212/227, 230, 231, 233, 237, 255, 257, 264, 267, 268

[56] References Cited

U.S. PATENT DOCUMENTS

| | | | |
|---|---|---|---|
| 600,973 | 3/1898 | Truax | 212/255 |
| 1,143,560 | 6/1915 | Voelker | 212/231 |
| 3,197,036 | 7/1965 | Mason | 212/231 |
| 3,207,044 | 9/1965 | Hall | 212/231 |
| 3,610,433 | 10/1977 | Milner, Jr. et al. | 212/264 |
| 3,828,941 | 8/1974 | Coutinho | 212/264 |
| 4,286,721 | 9/1981 | Ashworth | 212/231 |

FOREIGN PATENT DOCUMENTS

| | | | |
|---|---|---|---|
| 973790 | 6/1960 | Fed. Rep. of Germany | 212/231 |
| 2507490 | 8/1976 | Fed. Rep. of Germany | 212/231 |
| 391777 | 4/1933 | United Kingdom | 212/231 |

*Primary Examiner*—Trygve M. Blix
*Assistant Examiner*—R. B. Johnson
*Attorney, Agent, or Firm*—Jordan and Hamburg

[57] ABSTRACT

A crane is comprised a foundation, a supporting pole elongating vertically from the foundation, an arm capable of rotatably moving on a plane parallel with the supporting pole, and a winding drum mounted at the tip end portion of the arm, the arm consisting of two arms elongating in parallel with each other, the drum being mounted between two arms. The crane is installed on the rooftop of a building or the like and capable of effectively pulling up an object from a narrow road onto a narrow rooftop and setting it up on a rooftop.

4 Claims, 6 Drawing Figures

CRANE

BACKGROUND OF THE INVENTION

The present invention relates to a crane which is installed on the rooftop of the building or the like and which is capable of effectively pulling up an object from a narrow road onto a narrow rooftop and setting it up on a rooftop.

The present applicant has previously proposed a solar ray collecting device in which solar rays are focused by a lens or the like and guided into an optical conductor and transmitted through an optical conductor to an optional desired place for use in illumination, etc. The afore-mentioned solar ray collecting device is often installed and used on the rooftop of a building. However, elevator towers, water-supply tanks, etc., are often built on the rooftops of buildings. Some of them have very little space left. Furthermore, in a big city (especially, a megalopolis), many roads are narrow, and therefore it may be very difficult to install such a solar ray collecting device a described above in a predetermined place on the rooftops of buildings.

SUMMARY OF THE INVENTION

The primary object of the present invention is to provide a crane capable of moving within a small area on a horizontal plane.

It is another object of the present invention to provide a crane capable of effectively pulling up an object onto a narrow rooftop of a building from a narrow road and installing it in a desired place there.

It is another object of the present invention to provide a crane which can be effectively used to install a solar ray collecting device on a rooftop of a building.

It is another object of the present invention to provide a crane which comprises a foundation, a supporting pole extending vertically from the foundation, an arm capable of rotatably moving in a plane parallel with the supporting pole, and a winding drum mounted at the tip of the arm, the arm consisting of two parts extending parallel to each other, the drum being mounted between the afore-mentioned two arm components.

The above and other objects, features and advantages of the present invention will become apparent from the following detailed description taken with the accompanying drawings.

BRIEF DESCRIPTION OF THE INVENTION

DESCRIPTION OF THE PREFERRED EMBODIMENTS

Figure 1:
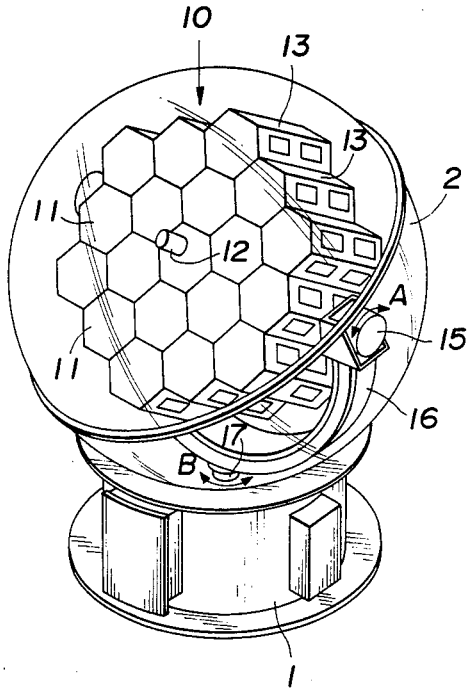
FIG.1 (PRIOR ART)
FIG. 1 is a perspective view of the solar ray collecting device as an example of an object carried by a crane according to the present invention.

FIG. 1 is a perspective view for explaining an embodiment of the solar ray collecting device proposed by the present applicant previously. FIG. 1, 1 is a cylindrical foundation, and 2 is a transparent dome-shaped head portion. The foundation and the head portion make up a capsule 3. Under the conditions for employing a solar ray collecting device 10, the device 10 is accommodated in a capsule 3 as shown in FIG. 1.

The solar ray collecting device 10 comprises a large number of (for instance, 19 pieces of) lenses 11 arranged concentrically for focusing the sun's rays, a solar ray direction sensor 12 for sensing the direction of the sun, a supporting frame 13 for unitarily supporting the lenses and the sensor, a first motor 15 for rotating the supporting frame together with the others supported thereby as shown by arrow A, a supporting arm 16 for supporting the lenses 11, the sensor 12, the supporting frame 13, the motor 15, the rotatable shaft 17 set up perpendicularly to the rotatable shaft of the motor 15, and a second motor (not shown in FIG. 1) for rotating the rotatable shaft 17 in the direction as shown by arrow B.

The solar ray direction sensor 12 senses the direction of the sun and generates a detection signal. The first and second motors are so controlled as to always direct the lenses toward the sun. The solar rays focused by the lenses 11 is guided into a large number of optical conductor cables not shown in FIG. 1 (19 cables in the embodiment of FIG. 1), the light-receiving end of which is arranged at the respective focal positions of the lenses. Then, the solar rays are transmitted through the optical conductor cables to an optional desired place.

On such occasions, the afore-mentioned solar ray collecting device is often installed and used on the rooftop of a building. However, elevator towers, water-supplying tanks, etc. are often built on the rooftops of buildings. Some of them have very little space left. Furthermore, in a big city (especially, a megalopolis), many roads are narrow, and therefore it may be very difficult to such a solar ray collecting device as described above in a predetermined place on the rooftops of buildings.

Figure 2:
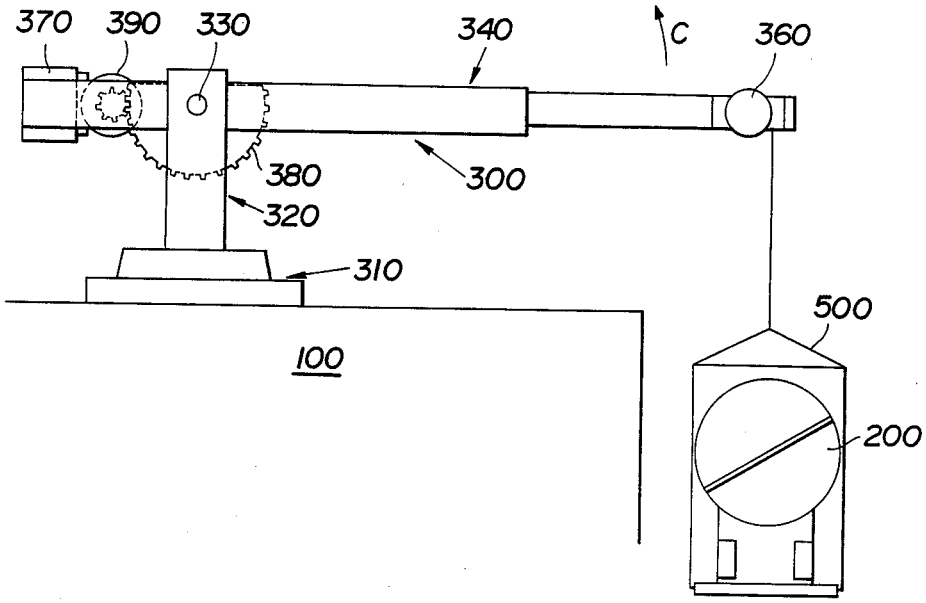
FIG. 2 is a side view of a crane showing the conditions for pulling up an object.
Figure 3:
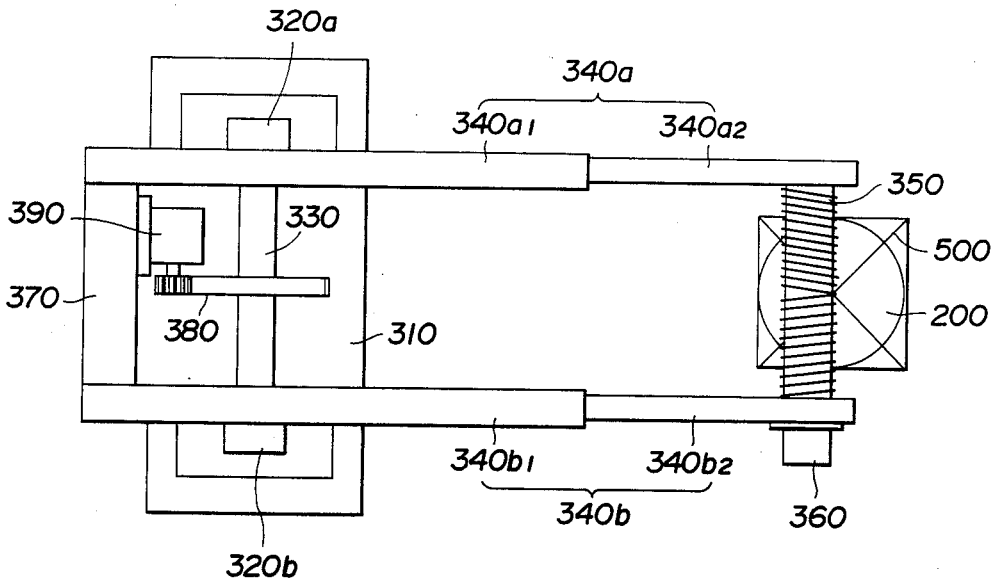
FIG. 3 is a plane view thereof.

FIG. 2 is a side view describing an embodiment of a crane according to the present invention. FIG. 3 is a plane view. In these figures, 100 is a building, 200 is a solar ray collecting device as previously described, and 300 is a crane. The crane 300 is comprised of a foundation 310, a supporting pole 320 which is set up on the foundation 310, a movable shaft 330, an arm 340 which is rotatably movable around the shaft 330, a winding drum 350 mounted at the tip of the arm 340, a motor 360 for moving the winding drum 350, a balancing weight 370, a gear 380 for rotatably moving the arm 340, and a motor 390 for driving the gear 380.

As shown in FIG. 3, the supporting pole 320 consists of two parts 320*a* and 320*b* which are set up on a foundation 310 at a predetermined interval, and the arm 340 which also consists of two parts 340*a* and 340*b* which are mounted parallel to each other at a predetermined interval. Components 340*a* and 340*b* consist of $\mathbf{340}a_1$, $\mathbf{340}a_2$; and $\mathbf{340}b_1$, $\mathbf{340}b_2$; respectively. The component arms $\mathbf{340}a_2$ and $\mathbf{340}b_2$ are so constructed that they can extend and contract freely against the component arms $\mathbf{340}a_1$ and $\mathbf{340}b_1$, respectively. The winding drum 350 is mounted between the arms $\mathbf{340}a_2$ and $\mathbf{340}b_2$ at the tip of the main arm 340.

When the winding drum 350 terminates winding the wire for suspending the solar ray collecting device 200, the wire is located at approximately the central position of the drum 350. At the time of lifting up the solar ray collecting device 200, the device 200 is located approximately at a center point between the component arms 340$a_2$ and 340$b_2$. At that point the motor 390 is driven so as to rotate the arms 340*a* and 340*b* around the rotatable shaft 330 in a direction shown by arrow C, and then the solar ray collecting device 200 passes between the initial horizontal positions of the arms 340*a* and 340*b* (340$a_2$ and 340$b_2$) and is transported as shown in FIG. 4.

Figure 4:
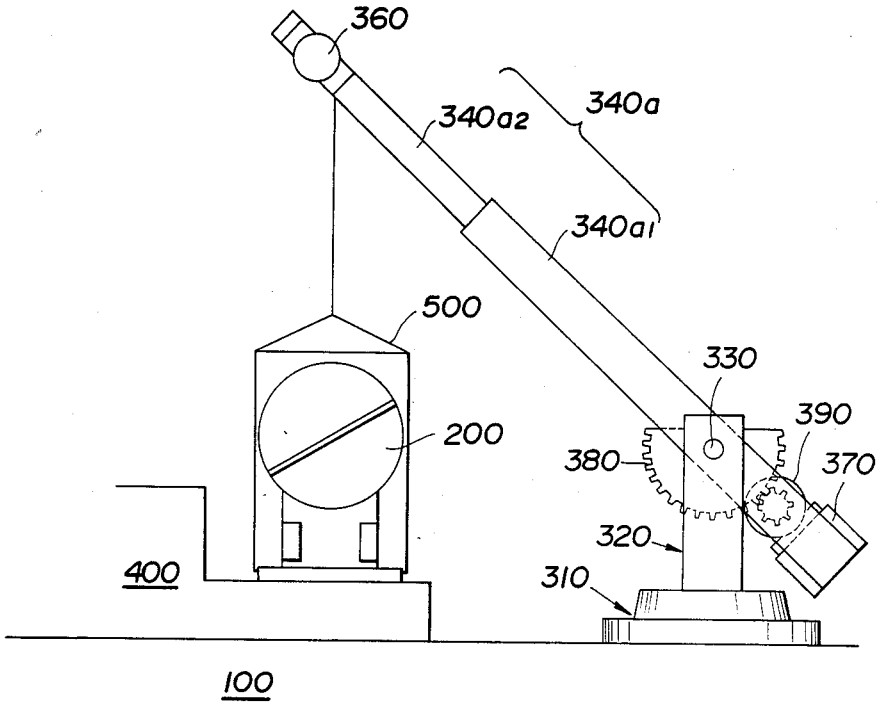
FIG. 4 is another side view thereof showing the conditions for letting down an object.

In FIG. 4, 400 is an entraining base for entraining a plurality of solar ray collecting devices 200. The present applicant has already proposed an entraining base 400. In the case of using a plurality of solar ray collecting devices, the entraining base 400 is installed on the rooftop of a building and the respective solar ray collecting device are arranged at designated positions. In such a manner, a large number of solar ray collecting devices can be effectively arranged in a narrow space.

On such an occasion, the location for installing the entraining base 400 is predetermined and the parking position for the truck transporting the solar ray collecting device is decided at the same time. If the crane according to the present invention is installed in a straight line connecting the entraining base 400 with the transporting truck, the solar ray collecting device can be installed at the desired position only by rotating the arm 340 in a vertical plane. Subsequently, it may even be possible to install a solar ray collecting device effectively on a narrow rooftop.

Furthermore, the foundation 310 is capable of rotating in a horizontal plane on some occasions. In such a manner, it may be possible to install the solar ray collecting device much more effectively thereon. A block represented by 500 is an auxiliary apparatus (carrying tool) for lifting up and carrying the solar ray collecting device 200. The detailed structure of the auxiliary apparatus is described in the specification of JAP No. 56-140942 (Japanese Patent Application) in more detail.

Figure 5:
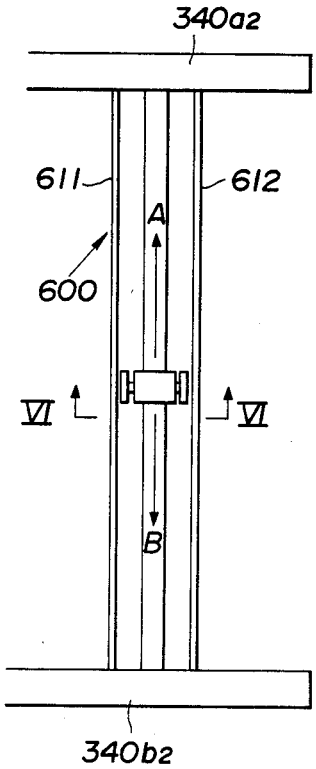
FIG. 5 is a plane view of the winding-up portion for explaining another embodiment of the present invention.
Figure 6:
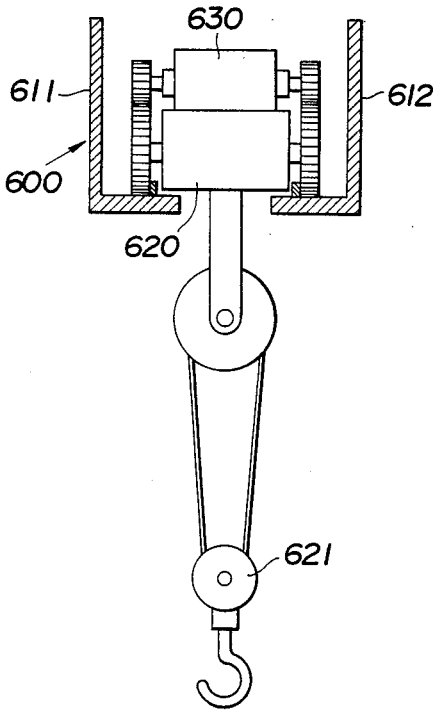
FIG. 6 is a cross-sectional view of the same taken on line VI—VI of FIG. 5.

FIGS. 5 and 6 are views of another embodiment of the present invention. FIG. 5 is a plane view thereof, and FIG. 6 is an enlarged cross-sectional view thereof taken on line VI—VI of FIG. 5.

In this embodiment, a running (movable) hoister 600 is employed instead of a winding drum 350 as shown in FIG. 3. In FIGS. 5 and 6, 611 and 612 are rails spanned between the arms 340$a_2$ and 340$b_2$, 620 is a hoister, and 630 is a motor for moving the hoister 620 horizontally. The hoister 620 can be moved by the motor 630 along the rails 611 and 612 in the directions shown by the arrows A and B.

Furthermore, needless to say, the hoister 620 contains a motor (not shown in the figures) for raising and lowering the hook 621. Therefore, according to the second embodiment, the hoister 620 can move freely between the arms 340$a_2$ and 340$b_2$. In comparison with the rotatable (winding) drum 350 of the first embodiment, the hook 621 can be moved in a wider range. Consequently, the parking position of the truck transporting the solar ray collecting device can be described more flexibly. When the solar ray collecting device is installed on the entraining base, the work of positioning the device can be done comparatively easy. Furthermore, in such a case, there is almost a need to be able to rotate the foundation 310.

An embodiment for installing a solar ray collecting device on a rooftop of a building by the use of a crane, according to the present invention, is described heretofore. However, the present invention is not always limited to the above-mentioned embodiments. That is to say, it may be possible to lift up and carry any optional object other than a solar ray collecting device. In the embodiment, the arm is capable of extending and contracting freely (as shown in FIGS. 2, 3, and 4), but it is not always necessary to make the arm capable of extending and contracting freely. Furthermore, it may be easily understood that, in respect to the rotatably movable mechanism of the arm assembly, various kinds of modifications, other than the embodiment described above, can be realized.

As is apparent from the foregoing description, according to the present invention, it may be possible to provide a crane capable of effectively lifting up an object onto a narrow rooftop of a building from a narrow road and installing it in a desired position thereof, that is, a crane capable of moving within a small area of a horizontal plane.

What is claimed is:

1. A crane for hoisting objects comprising foundation means, a support means extending vertically upwardly from said foundation means, said support means comprising two vertically extending support members spaced from one another, a pair of parallel and spaced arms, pivotal means pivotably mounting said pair of spaced arms on said support means for pivotable movement about a generally horizontal axis, said pivotal means comprising a movable shaft extending between said two spaced support members, said spaced arms being mounted on longitudinal end portions of said movable shaft such that rotation of said movable shaft pivots said spaced arms about the axis of said movable shaft, a driven gear mounted on said movable shaft at an intermediate section of said movable shaft between said spaced arms, said spaced arms having inner terminating end portions which are spaced from one another, a balancing weight mounted on said spaced arms in said space between said inner terminating end portions, a motor mounted on said balancing weight, said motor having a driven gear engageable with said driven gear on said movable shaft for rotating said driven gear to thereby pivot said movable shaft and thereby pivot said arms about said generally horizontal axis, said spaced arms having outer terminating end portions which are spaced from one another, and a winding drum means mounted on said spaced arms in said space between said outer terminating end portions, said winding drum means including means operable to wind and unwind a wire cable to raise and lower a working end of the wire cable such that when the wire cable is wound up on the winding drum to a maximum wind-up position, said working end is located substantially at the longitudinal center of said winding drum so that any object lifted by the wire cable is substantially centrally disposed between said two arms, whereby said crane is capable of lifting and pivoting objects having a transverse dimension substantially equal to the distance between said space arms such that the transverse dimension of said object can be accommodated between said spaced arms as said arms are pivoted about said pivotal means.

2. A crane according to claim 1, wherein each of said spaced arms comprises a first arm part and a second arm part, said first arm parts being mounted on said shaft, said second arm parts mounting said winding drum means, said second arm parts being longitudinally extendable and retractable relative to said first arm parts.

3. A crane according to claim 1 further comprising motor menas on said winding drum means for rotatingly driving said winding drum means, said winding drum means comprising a cylindrical drum on which said wire cable is wound as the cylindrical drum is rotated by said motor means.

4. A crane according to claim 1, wherein said winding drum means comprises a running hoister and rails extending between said two spaced arms on which said hoister is movable in a direction perpendicular to the longitudinal axis of said arms, said hoister having a motor for moving said hoister along said rails, said hoister also having a hook which can be raised and lowered for raising and lowering an object to be hoisted.

* * * * *